United States Patent [19]

Chapman

[11] 4,036,203

[45] July 19, 1977

[54] ELASTIC BAND TYPE TOY CANNON

[76] Inventor: Clyde H. Chapman, 9535 Yorkwood, Houston, Tex. 77016

[21] Appl. No.: 638,181

[22] Filed: Dec. 5, 1975

[51] Int. Cl.[2] ..... F41B 7/00

[52] U.S. Cl. ..... 124/21; 124/37; 124/29

[58] Field of Search ..... 124/29, 27, 35 R, 41, 124/21, 2, 22, 37, 31; 42/55; 89/37 R; 273/101

[56] References Cited

U.S. PATENT DOCUMENTS

| | | | |
|---|---|---|---|
| 159,003 | 1/1875 | Wiedemann et al. | 124/21 |
| 706,399 | 8/1902 | Fifer | 124/29 |
| 1,151,663 | 8/1915 | Carter | 124/29 |
| 1,360,410 | 11/1920 | Jones | 124/29 |
| 3,108,583 | 10/1963 | Andis | 124/22 |

*Primary Examiner*—Richard C. Pinkham
*Assistant Examiner*—William R. Browne
*Attorney, Agent, or Firm*—Donald Gunn

[57] ABSTRACT

A toy cannon is disclosed which incorporates an elongate cylindrical barrel. A projectile is hurled by the cannon by inserting it at the mouth of the barrel. Inside the barrel, a plunger travels at the urging of rubber bands which are mounted on the exterior and parallel to the barrel. The barrel is preferably split so that the plunger has a pair of supporting and extending hooks which are located on the exterior. The hooks engage the rubber band to enable the toy cannon to fire. The toy cannon incorporates a latch at the rear of the barrel to hold the plunger at a caught position. A cowling is provided on the outer surface of the barrel to house the rubber bands that act on the plunger.

4 Claims, 7 Drawing Figures

ELASTIC BAND TYPE TOY CANNON

BACKGROUND OF THE INVENTION

This apparatus is directed to a toy cannon. The toy cannon of the present invention is a device or toy intended for amusement purposes. The toy cannon of the present invention is relatively simple to construct and is therefore easily used by a relatively young child. In particular, the present invention is powered by a pair of side mounted rubber bands. It is anticipated that the rubber bands will require replacement from time to time. To this end, the rubber bands are located where they can be easily replaced or removed as the case may be. In the event that a rubber band should break, replacement is easily achieved.

The toy cannon itself has an elongate barrel which is cylindrical in cross section. It is slotted but the slots do not run the full length of the device. The muzzle end of the barrel is unslotted thereby providing guidance to the projectile placed in the barrel. At the opposite end, the barrel incorporates a latch mechanism which grabs and holds the plunger. The latch mechanism will hold the plunger momentarily or indefinetly depending on the requirements of the user. The latch is easily released, there being a latch string on the exterior which can be hand pulled.

The cannon is mounted on a moveable carriage and can be elevated to aim the projectile at a selected angular trajectory. This thus enables it to provide a reasonable facimile to a more expensive toy or an actual cannon.

DESCRIPTION OF THE PREFERRED EMBODIMENT

The preferred embodiment of the present invention is a toy cannon constructed with an elongate barrel having a circular muzzle end extending to a breach portion. At the breach, a pivotted latch with hook is located. The hook latches to the back side of a moveable plunger which slides in the barrel. The plunger is positioned and guided by means of a pair of protruding ears which extend on the exterior of the barrel. The ears enable rubber bands to be hooked to them. The rubber bands are anchored at the forward end of the barrel near the muzzle to fixed tabs. The rubber bands provide an evenly applied force to the plunger. The force applied to both sides of the plunger causes it to move forward smoothly thereby hurling a projectile from the muzzle of the gun. The plunger travels forward in the barrel but it does not emerge from the end of the barrel, the plunger being limited in travel by means of length wise slots which terminate short of the muzzle. The barrel itself preferably includes externally located cowlings on the side which limit the exposure of the rubber bands. The barrel itself is located on a pivotal carriage to enable it to be inclined at any specified projectory.

DESCRIPTION OF THE PREFERRED EMBODIMENT

Figures 1, 2, 3:
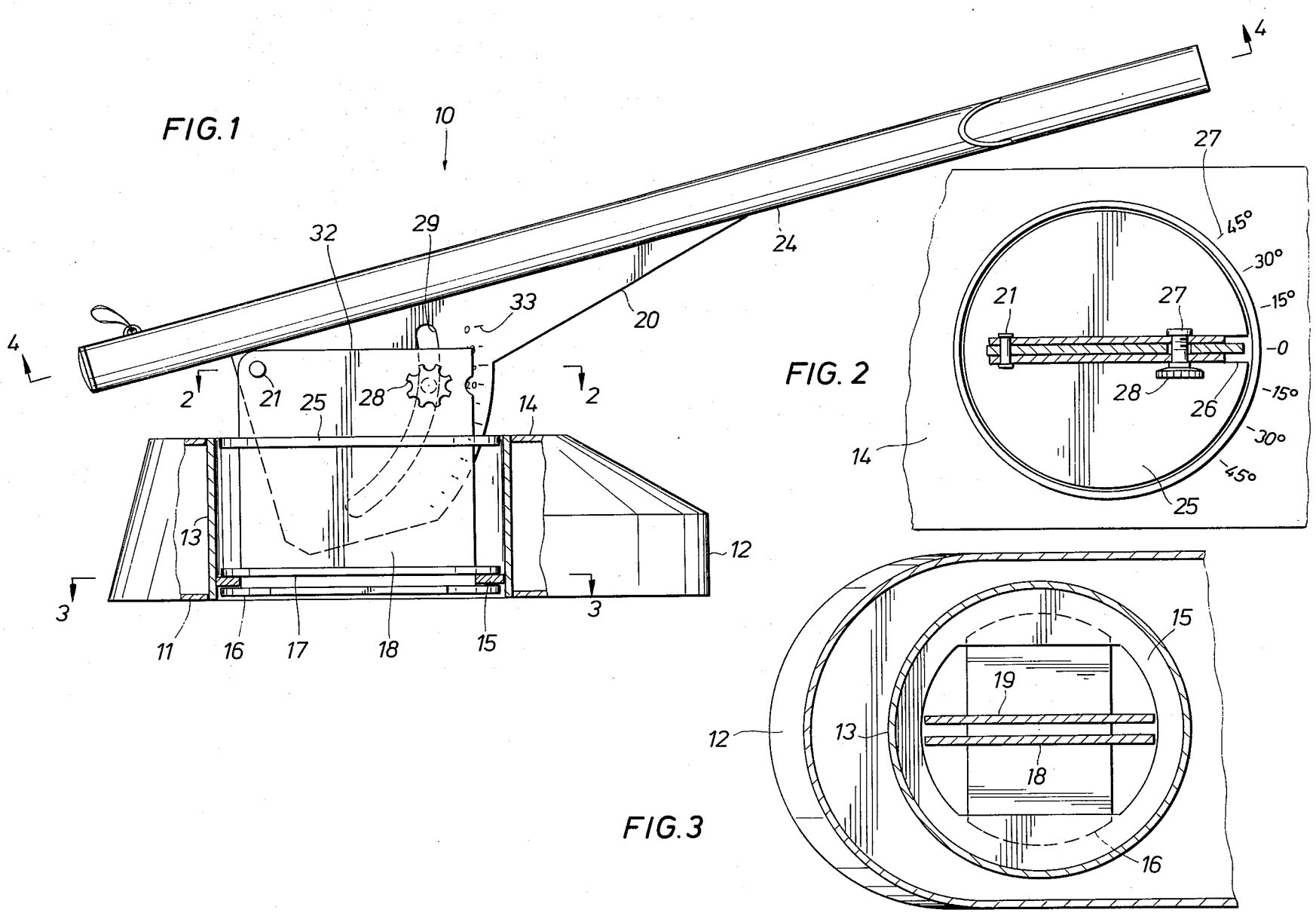
FIG. 1 is a side view of the toy cannon of the present invention particularly illustrating a mounting apparatus which moves the toy cannon to a specified position.
FIG. 2 is an enlarged sectional view of the mounting apparatus showing the elevation apparatus and means for positioning the cannon at a specified azimuth.
FIG. 3 is a sectional view along the line 3—3 of FIG. 1 showing details of construction of the rotatable carriage which supports the toy cannon.

In FIG. 1, the toy gun of the present invention is identified by the numeral 10. The cannon will be described with attention first directed first to the lower portions or the base which supports the cannon itself. They provide a mechanism whereby the cannon is positioned in elevation and azimuth. To this end, the toy cannon includes a bottom plate 11 which extends to an encircling cowling 12. The cowling 12 closes a vertical cylindrical internal wall 13. The wall 13 extends to a top plate 14 which is fixed around the cowling 13. The cowling 13 defines a hollow cylindrical cavity. An internal shoulder or lip 15 is located in the cavity. The lip 15 protrudes inwardly a fixed distance. The lip 15 is concentrically arranged within the hollow cylindrical well 13.

A circular plate 16 is positioned adjacent to the lip 15. A second circular plate 17 is arranged above the inwardly protruding lip 15. The circular plates 16 and 17 are spaced just above and below to thereby sandwich the lip 15. They define a moveable turn table. The turn table is able to rotate because there is sufficient clearance on the periphery to avoid binding against the cylindrical wall 13.

The plates 16 and 17 are joined to an upright mounting bracket 18. The bracket 18 is better shown in FIG. 3 of the drawings. It will be observed that there is a duplicate upright bracket 19. The brackets or plates 18 and 19 are vertical, supported by the plates 16 and 17. Preferably, they pass through the plate 17. The plates 16 and 17 thus support the upright brackets 18 and 19 in a vertical plane spaced apart from one another. The gap between the upright brackets 18 and 19 is relatively narrow but is sufficiently wide to receive a quadrant plate 20 shown in FIG. 1.

The plate 20 is pinned at 21 to the bracket plates 18 and 19. It is preferably pinned at one corner. The plate 20 is joined to the lower side of the barrel which is indicated generally at 24. The plate thus serves as a stiffening member and is also a support thereby positioning the barrel 24 where it pivots around the pin 21. The upstanding brackets 18 and 19 are attached to a circular plate 25 better shown in FIG. 2 of the drawings. It is coincident with the plane of the top plate 14 and is located within the cylindrical wall 13. Some clearance is allowed but the gap between the top plate 25 and the cylindrical wall 13 is sufficiently close to thereby limit the wobble of the apparatus within the cylindrical well 13. As a consequence, the cylindrical well serves as a guide for the rotatably mounted equipment. The circular plate 25 prevents wobble and aligns the bracket plates 18 and 19 for smooth rotation.

The circular plate 25 has another purpose. It positions a gap 26 immediately adjacent to calibration marks indicated at 27 in FIG. 2. The calibration marks define the zero azimuth position of the base 12. The zero azimuth position is further accompanied by right and left azimuth positions through any specified angle such as the illustrated arrangement on FIG. 2. Alternate azimuth indications or markings can be incorporated as desired. FIG. 2 shows the details of the construction of the pin 21 which adjoins the plate 20. The brackets 18 and 19 have openings formed in them and a bolt 27 passes through them. The bolt 27 is provided with a head located on one side of the brackets and a large knurled knob 28 is located on the opposite side of the plate. The knurled knob can be hand rotated. When it is, it tightens the bolt to clamp the plates 18 and 19 about the plate 20. This is used to fix the elevation of the barrel 24. As shown in FIG. 1 of the drawings, the plate 20 is cut with an arcuate groove 29. the groove 29 is centered about the pin 21. It is thus located so that the bolt 27 passes through it. This enables the plate to be rotated without binding the bolt 28. When the barrel 24 achieves a desire elevation, the nut 28 is rotated, thereby clamping the brackets 18 and 19 against the plate 20 and walking locking barrel at a specified location. The top edge of the plate 18 is identified at 32 and comprises a marker for cooperation with a set of calibrations indicated at 33. The calibrations 33 are located on the plate 20 and define the angle of elevation of the cannon barrel 24. As the cannon barrel is raised or lowered, the knurled nut 28 is loosened and then locked to specify the angle of of elevation. The angle is measured by the use of the top edge 32 as a marker. It is read opposite the set of calibrations 33 to determine the angle of elevation.

Figure 5:
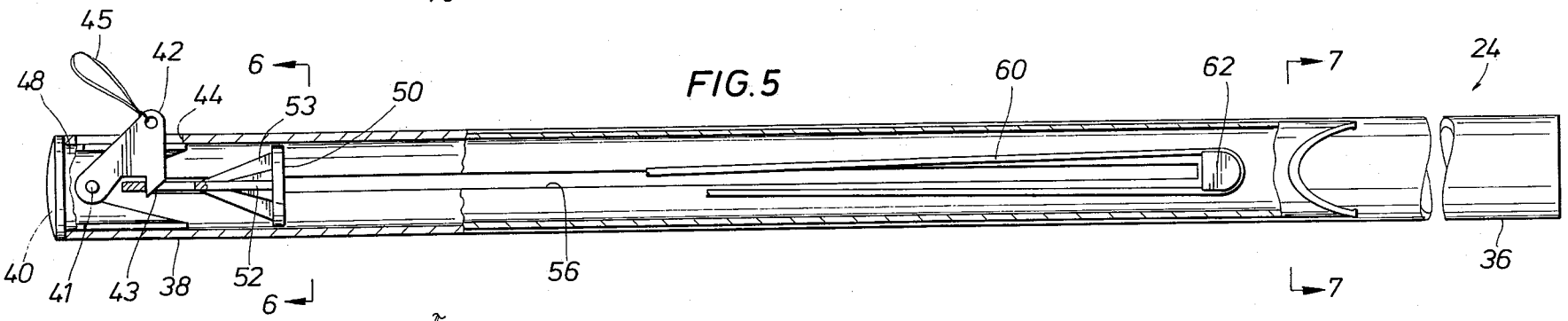
FIG. 5 is a sectional view taken along the line of 5—5 of FIG. 4 illustrating additional details of the construction of the barrel.
Figure 7:
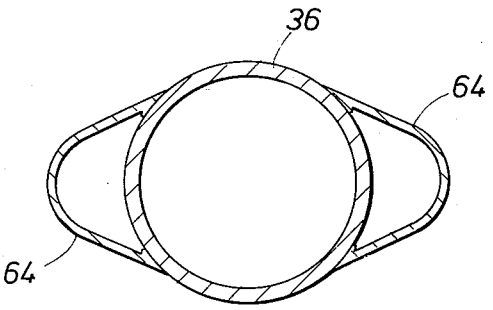
FIG. 6 is a transverse sectional view taken along the line 6—6 of FIG. 5 showing the relationship of the protruding ears of fitted within the barrel and FIG. 7 is a sectional view taken along the line of 7—7 of FIG. 5 showing the muzzle end of the barrel.

Attention is next directed to FIG. 5 of the drawings wherein the barrel 24 is shown in greater detail. The barrel 24 includes a muzzle 36. The muzzle 36 is at the remote or outer end of the barrel. A breach end 38 is closed over by a transverse end member 40. The breach end of the barrel is at the lower end, and defines a supporting structure for certain equipment included at the breach. At the breach end, a transverse pin 41 extends across the barrel and secures a firing latch 42. The latch 42 is mounted for pivotal movement. The latch 42 incorporates a hook 43. The hook 43 extends downwardly and is pivotally mounted for rotation about the pin 41. The latch 42 extends through a slot 44 in the side wall of the barrel. A pull string 45 is attached to the exposed end of the latch enables a person to fire the cannon. The latch is rotated in a counter clock-wise direction upon firing. The hook 43 engages and holds a plunger as will be described. The breach and the pin 41 are supported by an internal grommet 48 located on the interior of the barrel. The grommet is slotted to coincide with the slot 44 on the top side manipulation.

Figure 4:
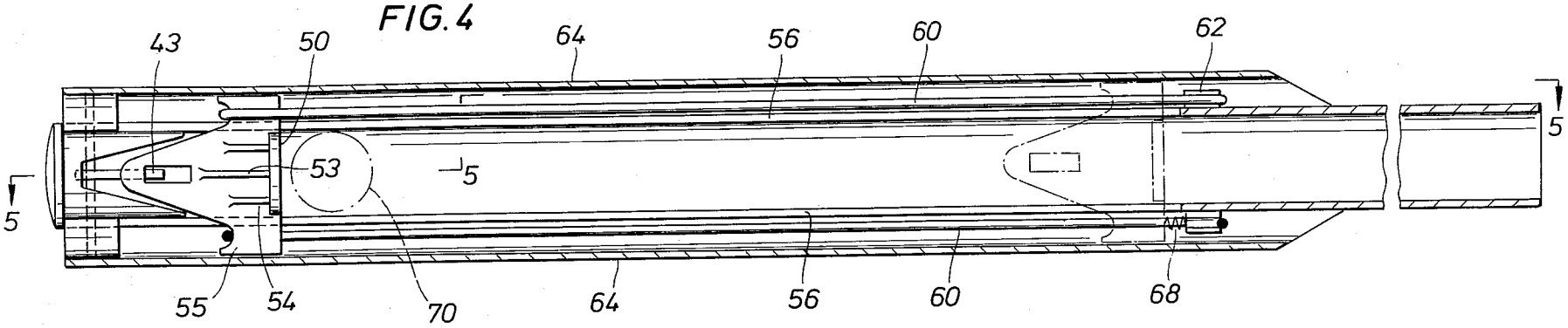
FIG. 4 is a sectional view taken along the diameter of the barrel showing details of construction and particularly illustrating an internal plunger and a means for firing a projectile from the barrel.
Figure 6:
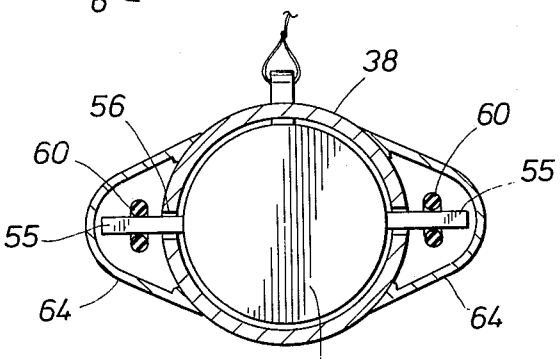

A plunger 50 is shown in FIG. 6 of the drawings. The plunger 50 is a transverse disc which fits snuggly within the barrel but is sufficiently smaller to allow it to travel freely along the barrel without binding. The disc 50 is shown in side view in FIG. 5 to support a perpendicular rearedly protruding plate 52. The plate 52 is notched to define a receptacle which receives the hook 43. The plate 52 is integrally formed with the plunger 50. The plate 52 is reinforced by means of an upstanding reinforcing gusset 53 better shown in FIG. 5. In addition, smaller reinforcing gussets are on the right and left as better shown in FIG. 4 and indicated by the numeral 54. The plate 52 is substantially wider than the diameter of the barrel 24. The plate 52 extends on the exterior of the barrel thus defining a protruding set of ears 55. The ears 55 are located on both sides of the plate. The ears extend through lengthwise slots 56 formed on both sides of the barrel. The slots 56 provide clearance for the protruding ears so that the plunger can travel through the barrel. The ears 55 are adapted to receive and support rubber bands which serve as the motive means for the present invention. To this end, the ears are shown in FIG. 4 to have a curved or hook like portion at the rear which supports the rubber bands identified by the numeral 60. It will be observed that duplicate equipment is provided on both sides of the apparatus. Thus, the barrel is slotted on both sides and the protruding ears are located on both sides.

The rubber bands which engage the protruding ears extend forwardly and hook on a fixed tab 62 shown in FIGS. 4 and 5. Again, duplicate equipment is provided on both sides of the barrel. Of particular interest, the slots 56 extend forwardly up the barrel but terminate short of the tab 62. The tabs 62 are contoured to receive and provide a groove or seat for the rubber bands 60. This assures that the bands will take a seat and not flop or jump off the protruding tabs when the toy cannon is fired. Rather, the toy cannon incorporates a somewhat U-shaped cowling identified by the numeral 64 again located symetrically on both sides of the apparatus. The cowling 64 thus encloses the rubber bands. It is duplicated on both sides as will be observed in viewing the drawings. The cowling 64 extends all the way to the breach plate 40. This protects against accidental snagging of the protruding ears 55 as they traverse the slot 56 at a higher rate of speed when the cannon is fired.

The cowling thus encloses the power mechanism to protect younger children who might use the toy of the present invention. All of the moving equipment is enclosed or encased. There is very little likelihood of accident as result of incorporation of the cowling.

It is preferable to glue the looped rubber bands 60 to the tabs 62. This keeps it from flying free of the equipment. Additionally, the rubber band can be tied immediately in front of the tab 55 so as to define a fairly narrow bight which keeps the band around the tab. To minimize recoil the protruding tab 62 is provided with a coil spring 68 on the rear side. This cushions the impact of the plunger mechanism as it travels forwardly.

In operation, the present toy is used in the following manner. It is rotated to a desired azimuthal position. This position is achieved and noted through the use of calibration marks 27 shown in FIG. 2. The nut 28 is loosened and the cannon barrel 24 is elevated to a desired elevation whereupon the nut is then tightened. When it is tightened, it clamps the barrel at the desired elevation. A toy projectile such as the projectile indicated in 70 in FIG. 4 is dropped into the barrel and is rammed home thereby pushing the plunger ahead of it to the caught position of FIG. 4. A suitable ram rod is used for this purpose. When the plunger is forced backwardly to the required location, the weight of the latch mechanism 42 causes the hook 43 to grap the opening or slot of the rear of the plunger assembly and hold the plunger assembly. When it is held, the cannon will not fire. The ram rod is removed. At this point, the toy cannon 10 is ready to discharge. Discharge is achieved easily. It is achieved by pulling on the cord 45 thereby lifting the latch from the opening in the plunger. When this occurs, the toy cannon will fire thereby hurling the projectile 70 some distance. The precise distance is dependent on many scale factors and the strength of the rubber bands 60. The rubber bands 60 can be doubled or trippled to increase the strength. Alternately, they can be weakened or reduced in number to decrease the strength in the even the cannon is too strong for use in a given circumstance.

In the event that the rubber band should break, the plunger is dropped to the forward end of the cannon. A rubber band is inserted into the cowling and is looped around the tab 55. To obtain clearance on one side or the other, the tabs are forced to the right or left as the case may be to increase the clearance on the side. The rubber band is looped around the particular tab 55 in question and thereafter is seated on the protruding tab 62 on the forward end of the cannon. It can be spot glued as a convenience.

The foregoing is directed to the preferred embodiment but the scope thereof is determined by the claims which follow.

I claim:

1. A toy cannon which comprises;

an elongate hollow barrel having a breach end and a muzzle end, there being a lengthwise slot extending along a substantial portion of said barrel and terminating short of said muzzle end;

a transversely extending projectile plunger slidably received within said barrel;

an outwardly projecting, protruding tabular means carried on said plunger and extending to the exterior of said barrel through the lengthwise slot in said barrel;

an elongate resilient force means adapted to be joined at one end to a fixed point relative to said barrel and at the other end to said protruding tabular means to impart axial movement to said plunger along said barrel; said force means being housed in cowling means extending along substantially the full length of the barrel and afixed to the outer surface of said barrel;

a pivot point near the breach end of said barrel;

a latch means pivotly mounted on said pivot point, said latch means incorporating a hook which engages and holds said plunger when said plunger is forced to the rear of said barrel against the force of said force means, said latch means holding said plunger means for a specified interval;

base means supporting said barrel and enabling said barrel to be aimed in a specified direction;

a turntable included in said base which rotates in a generally horizontal plane about a vertical axis to thereby permit adjustment of said barrel to a specified azimuthal angle;

a fixed pivot point included in said base, a means joining said barrel to said pivot point, and a means for locking said barrel at a specified angle of elevation upon rotation about said pivot point;

an opening means formed in the side of said barrel which permits said latch means to extend therethrough and which is externally exposed for hand manipulation to release said latch means; and two protruding tabular means carried on said plunger which are arranged diametrically opposite of one another and wherein said barrel has a pair of lengthwise opposing slots, said tabular means protruding respectively through opposing slots.

2. The apparatus of claim 1 wherein said plunger includes a rearwardly projecting elongate member having a slot formed therein, said slot being adapted to receive and releasably hold the hook carried by said latch means.

3. The apparatus of claim 1 wherein said plunger is reinforced on the rear face thereof by a plurality of reinforcing gussets.

4. The apparatus of claim 1 wherein duplicate force means are installed on opposite sides of said barrel and are engaged respectively with each of the tabular means, and further including a fixed anchor means on said barrel for each of said force means.

* * * * *